United States Patent [19]

Kausträter

[11] Patent Number: 4,466,333

[45] Date of Patent: Aug. 21, 1984

[54] ARMORED VEHICLE

[75] Inventor: Gert Kausträter, Augsburg, Fed. Rep. of Germany

[73] Assignee: Kuka Wehrtechnik GmbH, Augsburg, Fed. Rep. of Germany

[21] Appl. No.: 346,603

[22] PCT Filed: Jun. 15, 1981

[86] PCT No.: PCT/EP81/00076

§ 371 Date: Feb. 8, 1982

§ 102(e) Date: Feb. 8, 1982

[30] Foreign Application Priority Data

Jun. 14, 1980 [DE] Fed. Rep. of Germany ..... 3022410

[51] Int. Cl.[3] ..... F41H 7/06

[52] U.S. Cl. ..... 89/36 H; 89/36 K; 89/46

[58] Field of Search ..... 89/36 H, 36 K, 45, 46, 89/47, 33 R, 33 MC, 33 B, 33 F, 34, 40 B

[56] References Cited

U.S. PATENT DOCUMENTS

| | | | |
|---|---|---|---|
| 3,333,507 | 8/1967 | De Meiss | 89/40 B X |
| 4,065,999 | 1/1978 | Hultgren | 89/47 X |
| 4,092,900 | 6/1978 | Hottinger | 89/34 X |
| 4,326,446 | 4/1982 | Magnuson | 89/34 X |
| 4,329,909 | 5/1982 | Tidström | 89/46 |

FOREIGN PATENT DOCUMENTS

| | | | |
|---|---|---|---|
| 17591 | 10/1980 | European Pat. Off. | 89/36 H |
| 1428746 | 10/1973 | Fed. Rep. of Germany | 89/40 B |
| 2149954 | 12/1973 | Fed. Rep. of Germany | 89/40 B |
| 53-33000 | 5/1978 | Japan | 89/46 |

*Primary Examiner*—Donald G. Kelly

*Attorney, Agent, or Firm*—Brooks, Haidt, Haffner & Delahunty

[57] ABSTRACT

The armored vehicle comprises on or in its armored body, a revolving turret and a shieldplate mounted thereon as a bearing for a gun carrier which carries a cartridge magazine designed as a container located laterally (to the left and/or right) or at the top or bottom or behind the gun carrier. The armored body has a closable opening therein, and a horizontal container slideway with a container reloading station is located within the armored body. At an indexed rotational position of the turret and simultaneously at a vertical indexed angular position of the gun carrier an empty container can be guided with the aid of a conveyor downward through the opening into the container reloading station and can be removed then by a loaded container moving up. The loaded container can then be brought by the conveyor upward into the locking position at the gun carrier.

2 Claims, 2 Drawing Figures

ARMORED VEHICLE

This invention relates to an armored vehicle with a revolving turret arranged on or in an armored body having a shieldplate mounted thereon which provides a bearing for a gun carrier which carries a magazine for cartridges. The magazine is a container which is releasably locked in position laterally to the left or right of the gun, at the top or bottom of the gun, or behind the gun.

The cartridges contained in the magazine can be belted or unbelted, and can have different calibers. Accommodating the cartridge magazine in its own container permits carrying larger quantities of cartridges than it would be possible to store in the turret by making use of spaces located elsewhere in the vehicle.

A disadvantage in previously known designs of this kind has been that in attaching the containers to the gun, the loader has had to give up the protection of the armored vehicle. This resulted not only in loss of time but also in increased effort and greater danger to life.

It is the object of this invention to avoid these disadvantages by designing the armored vehicle such that the reloading of the containers can take place on the exterior of the gun carrier located outside the armored body directly from the interior of the vehicle by the aid of mechanical means.

This problem is solved according to the invention by providing a closable opening in the armored body and by providing a horizontal slideway within the armored body. The slideway has a container reloading station located such that at an indexed rotational position of the turret and simultaneously at an indexed vertical angular position of the gun carrier an empty container after having been unlocked can be brought by means of a conveyor downward through the opening in the armored body to the container reloading station on the slideway. The container can then be moved on the container slideway out of the container reloading station by means of a filled replacement container which moves up and occupies the place of the empty container. The replacement container can then be brought out of the container reloading station into the locking position at the gun carrier by the conveyor means.

The invention integrates the gun with the interior of the vehicle in a manner which permits reloading independently of existing turrets—and their size—and, as it were, bypassing the turret with auxiliary means, and this with relatively simple technology and at any event such that the loader need not move out of the protective body of the vehicle for the purpose of reloading. The conveyors can be chains or links actuated by pressure media.

For the conveyor means advantageously a second container slideway can be provided, leading from the container reloading station up to the gun carrier. The container slideway can be tracks and comprise guide elements which cooperate with corresponding guide elements on the containers. The second container track is intended for removal of the emptied container from the gun carrier and for bringing up the replacement container.

The indexed vertical angular position of the gun carrier expediently corresponds to the greatest possible angle of elevation.

An embodiment of the invention is illustrated in the drawings, in which.

Figure 1:
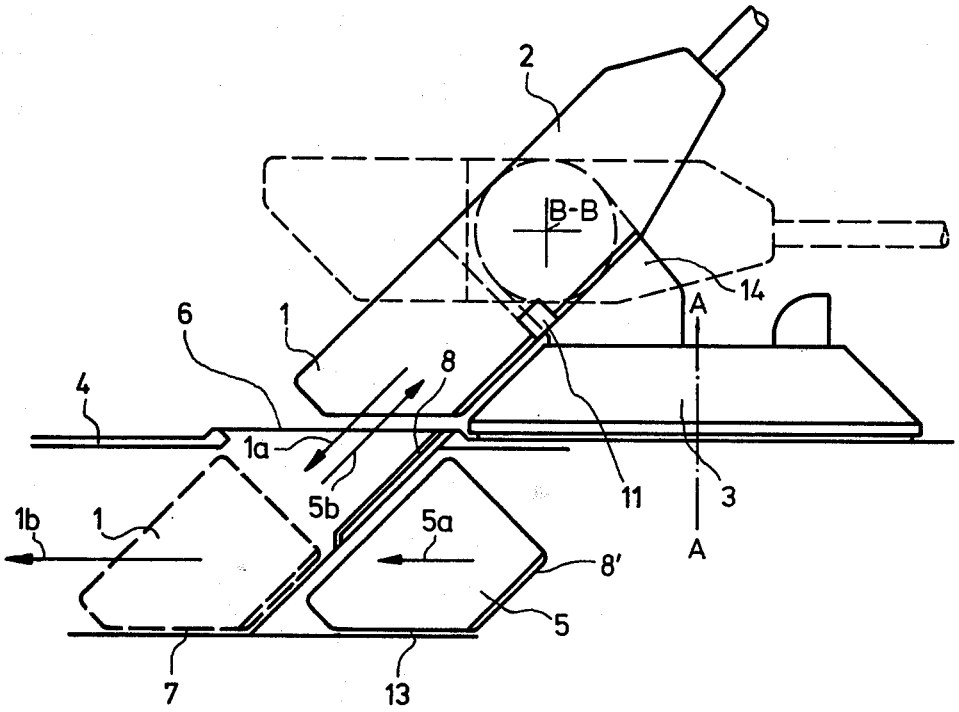
FIG. 1 is a front elevation.

In the drawings the reference numeral 4 indicates a portion of the armored body of an armored vehicle from which a part of a turret 3 protrudes. Turret 3 revolves about an upright pivot line AA. A shieldplate 14 rises from turret 3 as unilateral bearing support for a gun carrier 2 which can be directed as to elevation about a horizontal pivot line B—B. Gun carrier 2, which holds the actual gun 9, carries a cartridge magazine in the form of a container 1 located to the outer rear left of gun 9. Magazine is locked in position as indicated by the reference numeral 10.

Figure 2:
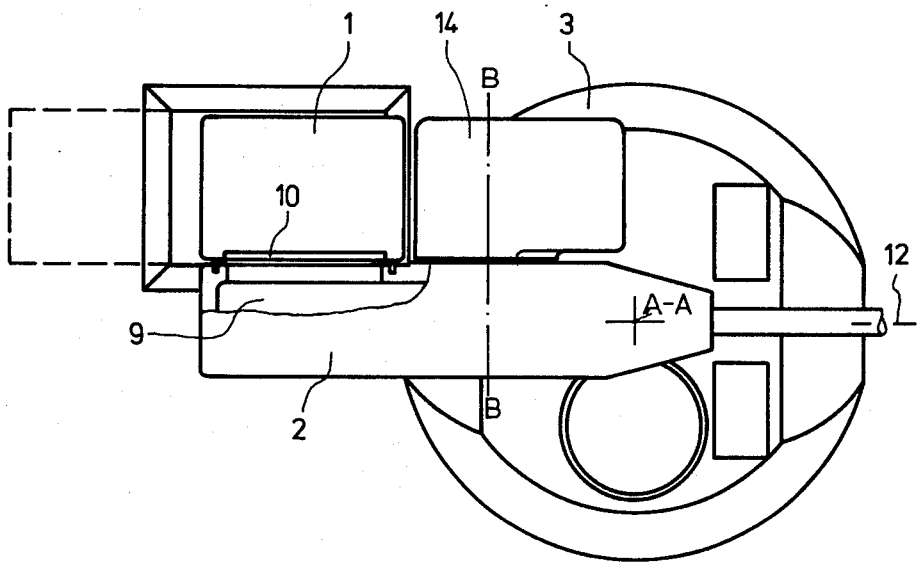
FIG. 2 is a top view.

When magazine 1 is emptied turret 3 is turned to the indexed position 12 (see FIG. 2) and gun carrier 2 is set on the indexed position adjusted to the maximum angle of elevation, as is shown in solid lines in FIG. 1. After opening 6 in armored body 4 has been cleared, the empty container 1 at gun carrier 2 is then in alignment with a reloading station 7 within armored body 4 such that the distance between container 1 and reloading station 7 along an oblique line 1*a* can be bridged by a conveyor provided on gun carrier 2 at 11. After unlocking, when the empty container 1 has been lowered by conveyor 11 into reloading station 7, a new loaded container 5 located in a standby station 13 is pushed in direction 5*a* horizontally into reloading station 7. In so doing, empty container 1 is pushed in direction 1*b* out of reloading station 7. After new container 5 has reached reloading station 7, it is conveyed upward by the conveyor 11 in direction 5*b*, aligned feeding to the locking position d10 being provided by guide elements 8, matching with corresponding guide elements 8' on the container.

What has been described above as an arrangement of container 1 to the left of the gun carrier 2 can, of course, be carried out also as an arrangement to the right, and both left and right at the top or bottom or if desired also behind the cannon. Likewise, the dispalcement in the direction of the arrows 5*a*, 1*b* can be arranged normal to the plane of the drawing instead of as above.

We claim:

1. In an armored vehicle having an armored body, a turret mounted on or in said body for rotation thereon, a shield plate mounted on said turret, said shield plate including gun carrier bearing means, and a gun carrier mounted on said bearing means for rotation thereon for receiving a magzine container releasably locked to said carrier at a container receiving position along said carrier, the improvement which comprises means defining an opening in said armored body, a horizontal slideway disposed within said armored body having a container reloading station at a position therealong, said turret and said gun carrier having rotational position relative to said armored body and said turret, respectively, in which said container receiving position on said gun carrier and said container reloading station on said slideway are aligned through said opening, conveyor means positionable through said opening for conveying a container between said receiving position and said reloading station, and said slideway including a first portion for removing empty containers from said reloading station and a second portion for delivering loaded containers to said reloading station.

2. The improvement according to claim 1 in which said turret is rotatable about a vertical axis, said gun carrier is rotatable about a horizontal axis, and said position of said gun carrier at which said container receiving position and container reloading station are aligned through said opening is the maximum angle of elevation of said gun carrier.

* * * * *